US007648587B2

(12) United States Patent
Kushida et al.

(10) Patent No.: US 7,648,587 B2
(45) Date of Patent: Jan. 19, 2010

(54) STEEL PRODUCT FOR USE AS LINE PIPE HAVING HIGH HIC RESISTANCE AND LINE PIPE PRODUCED USING SUCH STEEL PRODUCT

(75) Inventors: Takahiro Kushida, Osaka (JP); Kazuyo Kushida, legal representative, Osaka (JP); Tomohiko Omura, Osaka (JP); Mitsuhiro Numata, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 264 days.

(21) Appl. No.: 10/588,122

(22) PCT Filed: Jun. 17, 2004

(86) PCT No.: PCT/JP2004/008542

§ 371 (c)(1),
(2), (4) Date: Aug. 1, 2006

(87) PCT Pub. No.: WO2005/075694

PCT Pub. Date: Aug. 18, 2005

(65) Prior Publication Data

US 2007/0217942 A1 Sep. 20, 2007

(30) Foreign Application Priority Data

Feb. 4, 2004 (JP) ..... 2004-028635

(51) Int. Cl.
*C22C 38/00* (2006.01)

(52) U.S. Cl. ..... 148/318; 148/328; 420/84; 420/126

(58) Field of Classification Search ..... 148/318, 148/328; 420/84, 126
See application file for complete search history.

(56) References Cited

U.S. PATENT DOCUMENTS

| | | | | |
|---|---|---|---|---|
| 3,904,447 | A | 9/1975 | Gondo et al. | |
| 4,105,474 | A * | 8/1978 | Nakasugi et al. | 148/506 |
| 5,555,916 | A | 9/1996 | Kushida | |
| 2003/0116231 | A1 | 6/2003 | O'Hara et al. | |

FOREIGN PATENT DOCUMENTS

| | | |
|---|---|---|
| JP | 55-26164 | 7/1980 |
| JP | 62-182220 | 8/1987 |
| JP | 63-103051 | 5/1988 |
| JP | 06-025743 | 2/1994 |
| JP | 06-220577 | 8/1994 |
| JP | 06-271974 | 9/1994 |
| JP | 06-271976 | 9/1994 |

(Continued)

*Primary Examiner*—Sikyin Ip
(74) *Attorney, Agent, or Firm*—Clark & Brody

(57) ABSTRACT

A steel product for a line pipe according to the invention has a composition containing, in mass %, C : 0.03% to 0.15%, Si: 0.05% to 1.0%, Mn: 0.5% to 1.8%, P: 0.015% or less, S: 0.004% or less, O: 0.01% or less, N: 0.007% or less, sol. Al: 0.01% to 0.1%, Ti: 0.024% or less, Ca: 0.0003% to 0.02%, and the balance consisting of Fe and impurities. The size of TiN in the steel product for a line pipe is at most 30 μm. The steel product has high HIC resistance and its crack area ratio can be reduced to 3% or less.

8 Claims, 3 Drawing Sheets

FOREIGN PATENT DOCUMENTS

| | | |
|---|---|---|
| JP | 7-30391 | 4/1995 |
| JP | 09-324216 | 12/1997 |
| JP | 2000-160245 | 6/2000 |
| JP | 2003-013175 | 1/2003 |
| JP | 2003-213366 | 7/2003 |
| JP | 2003-342675 | 12/2003 |
| KR | 10-0256350 | 5/2000 |
| KR | 2002-0041080 | 6/2002 |

* cited by examiner

STEEL PRODUCT FOR USE AS LINE PIPE HAVING HIGH HIC RESISTANCE AND LINE PIPE PRODUCED USING SUCH STEEL PRODUCT

TECHNICAL FIELD

The present invention relates to a steel product for use as a line pipe and a line pipe produced using the steel product, and more specifically, to a steel product for use as a line pipe having high HIC resistance and a line pipe produced using the steel product.

BACKGROUND ART

Crude oil or natural gas produced in recent years contains wet hydrogen sulfide ($H_2S$). Therefore, hydrogen embrittlement derived from the hydrogen sulfide is a problem in oil country tubular goods for use in drilling an oil or natural gas well or line pipes for transporting produced crude oil or natural gas. The hydrogen embrittlement includes sulfide stress cracking (hereinafter simply as "SSC") caused in a steel product under static external stress and hydrogen induced cracking (hereinafter simply as "HIC") caused in a steel product with no external stress thereupon.

The oil country tubular goods have ends in a screw joint form. A plurality of oil country tubular goods are coupled with each other by their screw joints and assembled in the vertical direction of an oil or gas well. At the time, the oil country tubular goods are subjected to tensile stress by their own weight. Therefore, it is particularly required that the oil country tubular goods have SSC resistance. As oil wells have come to be more deeply drilled in recent years, the oil pipes must have even higher SSC resistance. In order to improve the SSC resistance, steel may be cleaned, the martensite ratio in the steel product may be increased, or the microstructure of the steel product may be refined.

Meanwhile, a plurality of line pipes are coupled with each other by welding and assembled basically in the horizontal direction, and therefore no such static stress as the case of the oil country tubular goods is imposed on the line pipes. Therefore, it is required that the line pipes have HIC resistance.

It is believed that HIC is caused by gas pressure generated when penetrating hydrogen accumulated at the interface between MnS elongated by rolling and a base material turns into molecular hydrogen. Therefore, in order to improve the HIC resistance of a line pipe, the following two conventional anti-HIC measures (first and second anti-HIC measures) have been taken. Many such anti-HIC measures have been reported for example as those in Japanese Patent Laid-Open Nos. 6-271974, 6-220577, 6-271976, and 9-324216.

In the first anti-HIC measures, the resistance of steel against hydrogen embrittlement is increased, details of which are as follows.

(1) To highly purify and clean the steel. More specifically, S is reduced as much as possible in during making the steel, so that the amount of MnS in the steel is reduced.

(2) To reduce macro center segregation.

(3) To control the form of sulfide inclusions (type A inclusions) by adding Ca. More specifically, the form of the sulfide-based inclusions is changed by Ca treatment from the form of MnS to the form of CaS that is harder to be elongated during hot-rolling.

(4) To control the microstructure by controlled rolling followed by accelerated cooling. More specifically, an original plate for steel pipe is subjected to controlled rolling and accelerated cooling. In this way, the microstructure of the original plate can be homogeneous and the hydrogen embrittlement resistance can be improved.

(5) To reduce Mn segregation and P segregation in the steel.

(6) To reduce type B inclusions such as alumina in the steel.

A number of specific methods of producing a steel product for use as a line pipe provided with these first anti-HIC measures have been reported for example as those in Japanese Patent Laid-Open Nos. 2003-13175 and 2000-160245.

In the second anti-HIC measures, hydrogen is prevented from penetrating the steel, details of which are as follows.

(7) To prevent hydrogen from penetrating the steel in a wet hydrogen sulfide environment by adding Cu.

(8) To prevent hydrogen from penetrating the steel by adding an inhibitor (corrosion inhibitor) or coating the surface.

However, the line pipes provided with the above-described, well known anti-HIC measures still suffer from HIC. Therefore, there have been further attempts to improve the HIC resistance.

DISCLOSURE OF THE INVENTION

It is an object of the invention to provide a steel product for use as a line pipe with higher HIC resistance and a line pipe produced using the steel product. More specifically, it is an object of the invention to provide a steel product for use as a line pipe having a crack area ratio of 3% or less and a line pipe produced using the steel product.

Based on the examination carried out about the initiation site of HIC caused in a steel product for use as a line pipe with the well known anti-HIC measures, the inventors have newly found that a TiN is the initiation site of HIC.

If a TiN is the initiation site of HIC, TiN should not be produced in the steel. More specifically, Ti should not be added to the steel. However, Ti fixes N (an element to lower the toughness) in the steel in the form of TiN. In other words, Ti that effectively improves the toughness of the steel is inevitably added. The inventors have then considered that the HIC resistance may be improved by reducing the size of TiN if not by entirely preventing TiN from being generated and has confirmed the concept. With reference to crack area ratios CAR obtained for a plurality of steel products having TiN in different sizes, how the HIC resistance improves with smaller TiN will be described in detail.

FIG. 1 is a graph showing the crack area ratio CAR as a function of the size of TiN in steel obtained from HIC tests. In the graph, the crack area ratio CAR is obtained by Expression (1). In the field of steel products for use as a line pipe in general, the HIC resistance is higher for smaller crack area ratios CAR.

$$\text{CAR}=\text{area of HIC generated in test specimen}/\text{area of test specimen} \quad (1)$$

In the steel product for a line pipe with the well known anti-HIC measures, however, it has not been exactly clear that around what level the crack area ratio CAR should be in order to further improve the HIC resistance. Therefore, the inventors have aimed to satisfy 3% or less for the crack area ratio CAR as a standard that is higher than the conventional level.

Table 1 gives the compositions of the sample materials in FIG. 1. As shown in Table 1, steels X1 to X4 having substantially the same compositions were welded and cast each into an ingot of 180 kg, then heated to 1250° C. for hot forging, and then subjected to quenching-tempering treatment. In this way, the yield strengths of the steel products were adjusted substantially to 65 ksi. At the time, as shown in Table 1, the amount of Ca in slag during melting, the $CaO/Al_2O_2$ value during melting, and the cooling rate during casting were varied among the steels X1 to X4. This is for changing the size of TiN among the steels X1 to X4.

TABLE 1

| | compositions (with the balance of Fe and impurities, in mass %) | | | | | | | | | | manufacturing conditions | | |
|---|---|---|---|---|---|---|---|---|---|---|---|---|---|
| steel | C | Si | Mn | P | S | Al | Ca | Ti | N | O | Ca addition (kg/ton) | slag composition ($CaO/Al_2O_3$) | cooling rate (° C./min) |
| X1 | 0.06 | 0.19 | 1.06 | 0.006 | 0.0019 | 0.041 | 0.006 | 0.015 | 0.0041 | 0.0036 | 0.24 | 0.9 | 200 |
| X2 | 0.05 | 0.24 | 1.25 | 0.008 | 0.0034 | 0.015 | 0.016 | 0.016 | 0.0034 | 0.0042 | 0.35 | 1.4 | 240 |
| X3 | 0.04 | 0.17 | 1.25 | 0.008 | 0.0026 | 0.021 | 0.003 | 0.016 | 0.0036 | 0.0043 | 0.21 | 1.3 | 250 |
| X4 | 0.06 | 0.19 | 1.09 | 0.009 | 0.0031 | 0.048 | 0.008 | 0.015 | 0.0034 | 0.0041 | 0.22 | 1.3 | 50 |

Five test specimens having a thickness of 10 mm, a width of 20 mm, and a length of 100 mm were prepared each from the produced the steels X1 to X4, and the size of TiN exposed on the surface of each of the test specimens was measured. More specifically, five regions of 1 $mm^2$ on a surface substantially parallel to the direction of forging at the surface of each of the test specimens was viewed. An SEM (Scanning Electron Microscope) of 100 times power was used for viewing. In each of the viewed regions, the ten largest TiNs were selected and their major axes were measured. At the time, as shown in FIG. 2, the longest straight line among the straight lines connecting two different points on the interface between the TiN and the base material was measured as the major axis of the TiN. The size of TiN was the average of the measured major axes (the average of the major axes of the 50 TiNs). The TiN was identified by EDX (Energy Dispersive X-ray Micro Analyzer).

After the size of TiN was measured, an HIC test was conducted. In the HIC test, the test specimens were immersed for 96 hours in a hydrogen sulfide-saturated, aqueous solution of 0.5% acetic acid and 5% sodium chloride at 1 atm and 25° C. After the immersion, HIC generated in the test specimens was measured by ultrasonic testing and the crack area ratios CAR were obtained based on Expression (1).

Based on the result of the HIC test, it has been found that the crack area ratio CAR is smaller for smaller TiNs. It has been found that when the size of TiN is 30 μm or less in particular, the crack area CAR is not more than 3%. Therefore, when the size of TiN in the steel product for a line pipe is reduced, the HIC resistance should be improved. When the size of TiN is 30 μm or less in particular, a steel product for a line pipe with higher HIC resistance would be provided.

The inventors have completed the following invention based on these findings.

The steel product for a line pipe with high HIC resistance according to the invention has a composition containing,in mass %, C: 0.03% to 0.15%, Si: 0.05% to 1.0%, Mn: 0.5% to 1.8%, P: 0.015% or less, S: 0.004% or less, O (oxygen): 0.01% or less, N: 0.007% or less, sol. Al (acid-soluble Al: Al solid solution in steel): 0.01% to 0.1%, Ti: 0.024% or less, Ca: 0.0003% to 0.02%, and the balance consisting of Fe and impurities. The size of TiN present in the form of inclusions in the steel product is 30 μm or less.

Here, TiN does not have to contain Ti and N in a ratio of 1:1 in mol %, and the TiN preferably contains at least 50% Ti in mass %. Meanwhile, the TiN may contain C, Nb, V, Cr, Mo, and the like in addition to Ti and N. Note that the TiN can be identified by a composition analyzing method such as EDX.

The size of the TiN can be obtained according to the following method. Five regions of 1 $mm^2$ on a section substantially parallel to the direction of rolling (or forging) a steel product for use as a line pipe is observed. An SEM of 100 times power is used for the observation. In each of the observed five regions, the ten largest TiNs exposed on the surface are selected. The major axes of the selected TiNs are measured, and the average of the measured major axes (i.e., the average value of the major axes of the 50 TiNs) is the size of the TiN. Note that the major axis refers to the largest one of straight lines connecting two different points on the interface between the TiN and the base material as shown in FIG. 2.

The steel product for a line pipe according to the invention preferably further contains at least one of Cu: 0.1% to 0.4% and Ni: 0.1% to 0.3%.

Hydrogen is prevented from penetrating the steel by the presence of Cu and Ni. Therefore, adding at least one of the elements can improve the HIC resistance of the steel product for a line pipe.

The steel product for use as a line pipe according to the invention preferably further contains at least one of Cr: 0.01% to 1.0%, Mo: 0.01% to 1.0%, V: 0.01% to 0.3%, B: 0.0001% to 0.001%, and Nb: 0.003% to 0.1%.

Adding at least one of the elements that reinforce steel such as Cr, Mo, V, B, and Nb, the steel product for use as a line pipe can have higher strength. Note that adding any of these elements does not affect the HIC resistance produced by reducing the size of TiN.

BEST MODE FOR CARRYING OUT THE INVENTION

Figure 1:
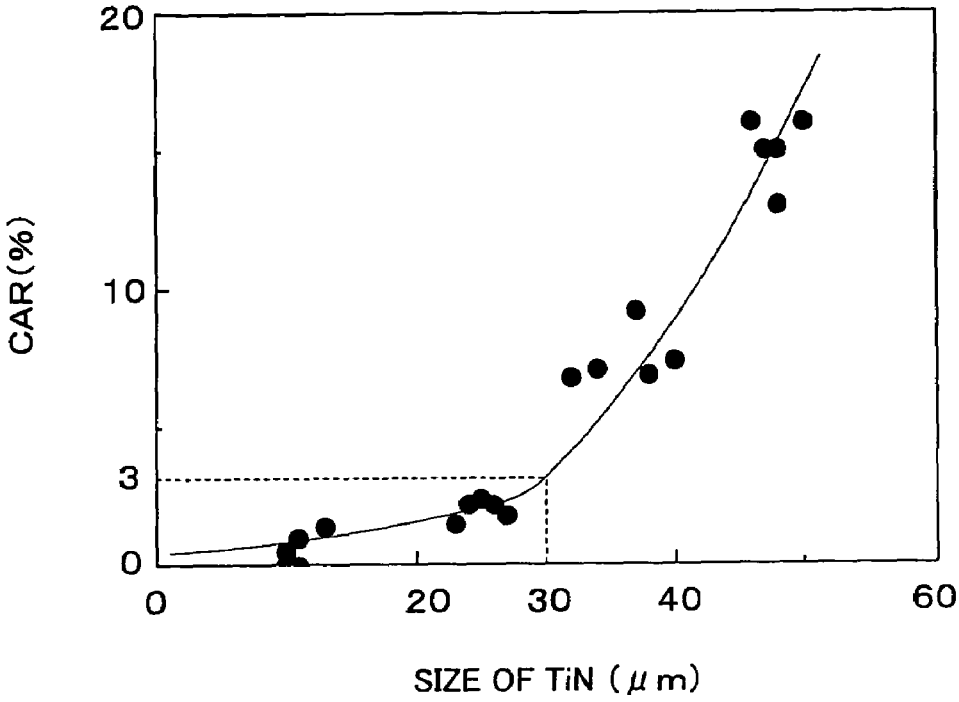
FIG. 1 is a graph showing the crack area ratio as a function of the size of TiN in steel.
Figure 2:
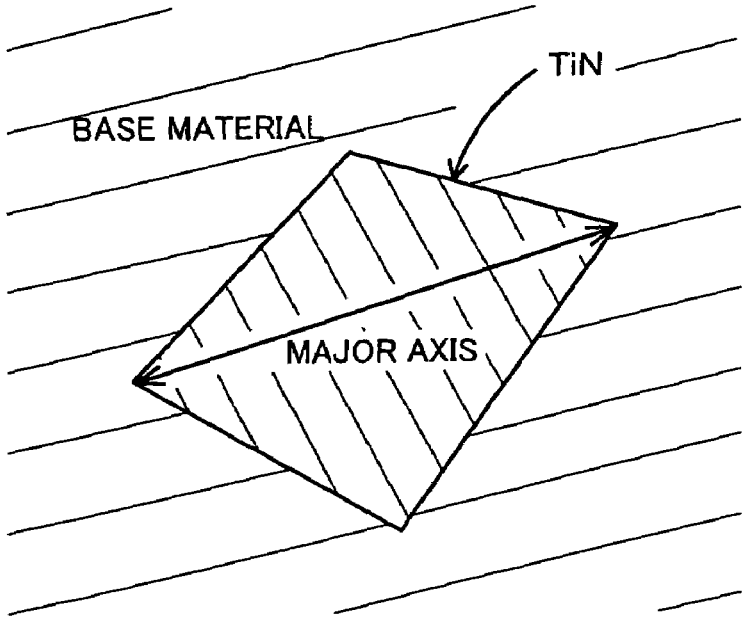
FIG. 2 is a schematic illustration showing the shape of a TiN in a steel product for a line pipe according to an embodiment of the invention.

Now, an embodiment of the invention will be described in detail in conjunction with the accompanying drawings.

1. Chemical Composition

A steel product for use as a line pipe according to the embodiment of the invention has the following composition. Hereinafter, "%" used in connection with alloy elements will refer to "in mass %."

C: 0.03% to 0.15%

Carbon is effective in increasing the strength of steel. The lower limit of the C content is 0.03% in order to keep necessary strength for a line pipe. Meanwhile, adding excessive C increases the hardness of the weld of the line pipe. The increase in the hardness of the weld could more easily cause SSC even for a line pipe less likely to have SSC. Therefore, the upper limit of the C content is 0.15%. The C content is preferably in the range from 0.05% to 0.13%.

Si: 0.05% to 1.0%

Silicon is effective in deoxidizing steel and if the content of Si is less than 0.05%, the effect is small. Therefore, the lower limit of the Si content is 0.05%. Meanwhile, adding excessive Si reduces the toughness of steel. Therefore, the upper limit of the Si content is 1.0%. The Si content is preferably in the range from 0.1% to 0.3%.

Mn: 0.5% to 1.8%

Manganese is effective in increasing the strength of steel. The lower limit of the Mn content is 0.5% in order to keep necessary strength for a line pipe. Meanwhile, adding excessive Mn causes considerable Mn segregation. In the Mn segregation area, a hardened structure that could cause HIC is formed. Therefore, the upper limit of the Mn content is 1.8%. The Mn content is preferably in the range from 0.8% to 1.6%.

P: 0.015% or less

Phosphorus is an impurity that helps center segregation and lowers the HIC resistance. Therefore, the P content is preferably as low as possible. Therefore, the P content is limited to 0.015% or less.

S: 0.004% or less

Sulfur is an impurity. When the S concentration is high in molten steel, the content of N that forms TiN is effectively reduced, but on the other hand the S forms MnS in the steel, which reduces the HIC resistance. Therefore, the S content is preferably as low as possible. Therefore, the S content is limited to 0.004% or less, preferably to 0.003% or less. O: 0.01% or less Oxygen is an impurity that reduces the cleanliness of the steel and therefore reduces the HIC resistance. The O content is preferably as low as possible. Therefore, the O content is limited to 0.01% or less, preferably to 0.005% or less.

N: 0.007% or less

Nitrogen is an impurity that forms a solid solution with steel and reduces the toughness. When nitrogen forms an inclusion as TiN, it is the initiation site of HIC, which reduces the HIC resistance. Therefore, the N content is preferably as low as possible. The N content is limited to 0.007% or less, preferably to 0.005% or less.

Ti: 0.024% or less

Titanium keeps N from forming a solid solution by itself and lets N precipitate as TiN, which improves the toughness. Meanwhile, adding excessive Ti increases the size of TiN, which becomes the initiation site of an HIC. The upper limit of the Ti content is 0.024%. The lower limit of the Ti content is preferably 0.005% and the upper limit is preferably 0.018%.

Ca: 0.0003% to 0.02%

Calcium controls MnS (to be the initiation site of HIC) to be in a spherical form in order to prevent HIC from being caused. In addition, as will be described, Ca reduces the size of TiN in association with Al. Meanwhile, adding excessive Ca reduces the cleanliness of the steel, which reduces the HIC resistance. Therefore, the Ca content is from 0.0003% to 0.02%, preferably 0.002% to 0.015%.

sol. Al: 0.01% to 0.1%

Aluminum is necessary for deoxidizing steel. In addition, as will be described, aluminum reduces the size of TiN in association with Ca. In order to let the element provide these effects, the lower limit of the sol. Al content is 0.01%. Meanwhile, adding excessive Al reduces the cleanliness and toughness of the steel, which reduces the HIC resistance. Therefore, the upper limit of the sol. Al is 0.1%. The sol. Al content is preferably in the range from 0.02% to 0.05%.

The balance consists of Fe but can contain other impurities for various causes associated with the manufacturing process.

The steel product for a line pipe according to the embodiment contains at least one of Cu and Ni if necessary. Copper and Ni are effective in improving the HIC resistance. Now, these elements will be described.

Cu: 0.1% to 0.4%

Copper improves corrosion resistance in a hydrogen sulfide environment. More specifically, Cu prevents hydrogen from penetrating the steel. Therefore, HIC is prevented from forming and propagating. Note however adding excessive Cu reduces the weldability of steel. Copper dissolves at high temperatures and lowers the grain boundary strength, which makes it easier for cracks to form at the time of hot-rolling. Therefore, the Cu content is in the range from 0.1% to 0.4%.

Ni: 0.1% to 0.3%

Nitrogen improves the corrosion resistance in a hydrogen sulfide environment similarly to Cu. The element also increases the strength and toughness of the steel. Note however that the effect saturates with excessive Ni addition. Therefore, the Ni content is in the range from 0.1% to 0.3%.

The steel product for a line pipe according to the embodiment further contains at least one of Cr, Mo, Nb, V, and B if necessary. These elements, Cr, Mo, Nb, V, and B effectively improve the strength of the steel. Now, these elements will specifically be described.

Cr: 0.01% to 1.0%

Chromium is effective in increasing the strength of steel whose C value is low. However, adding excessive Cr reduces the weldability and the toughness of the weld. Therefore, the Cr content is in the range from 0.01% to 1.0%.

Mo: 0.01% to 1.0%

Molybdenum is effective in improving the strength and toughness. However, adding excessive Mo reduces the toughness. Therefore, the Mo content is in the range from 0.01% to 1.0%, preferably in the range from 0.01% to 0.5%.

Nb: 0.003% to 0.1%

V: 0.01% to 0.3%

Adding Nb and V both refine the grains of the steel to improve the toughness and let carbides precipitate to improve the strength of the steel. However, adding excessive amounts of these elements reduces the toughness of the weld. Therefore, the Nb content is in the range from 0.003% to 0.1%, preferably in the range from 0.01% to 0.03%. The V content is in the range from 0.01% to 0.3%, preferably in the range from 0.01% to 0.1%.

B: 0.0001% to 0.001%

Boron is effective in improving the hardenability and strength of the steel. The lower limit of the B content to provide the effect is 0.0001%. Meanwhile, the effect saturates with excessive B addition, and therefore the upper limit of the B content is 0.001%.

2. Manufacturing Method

Figure 3A:
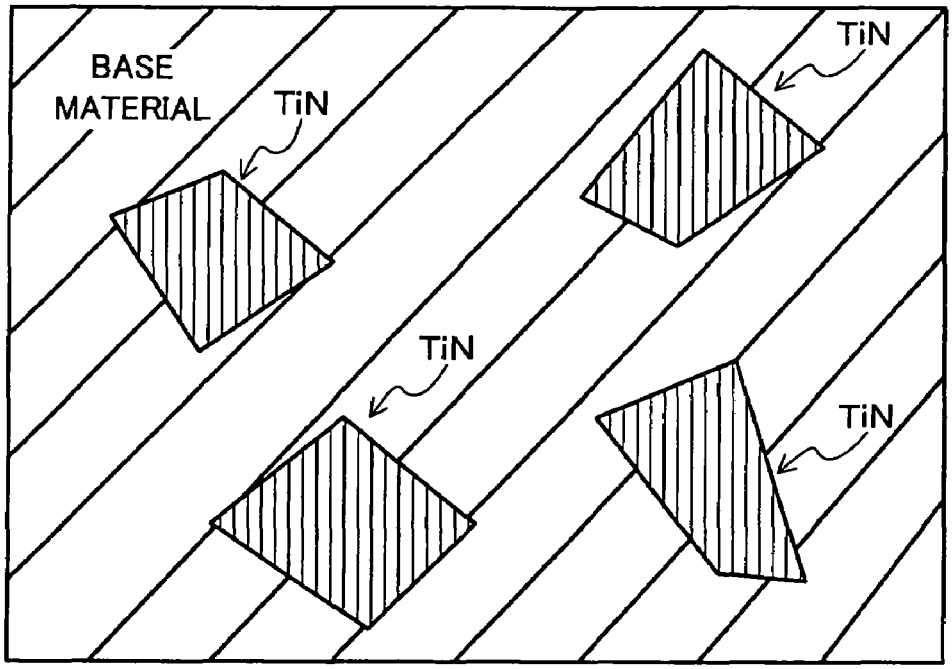
FIG. 3A is a schematic view showing the shape of inclusions in a conventional steel product for a line pipe.
Figure 3B:
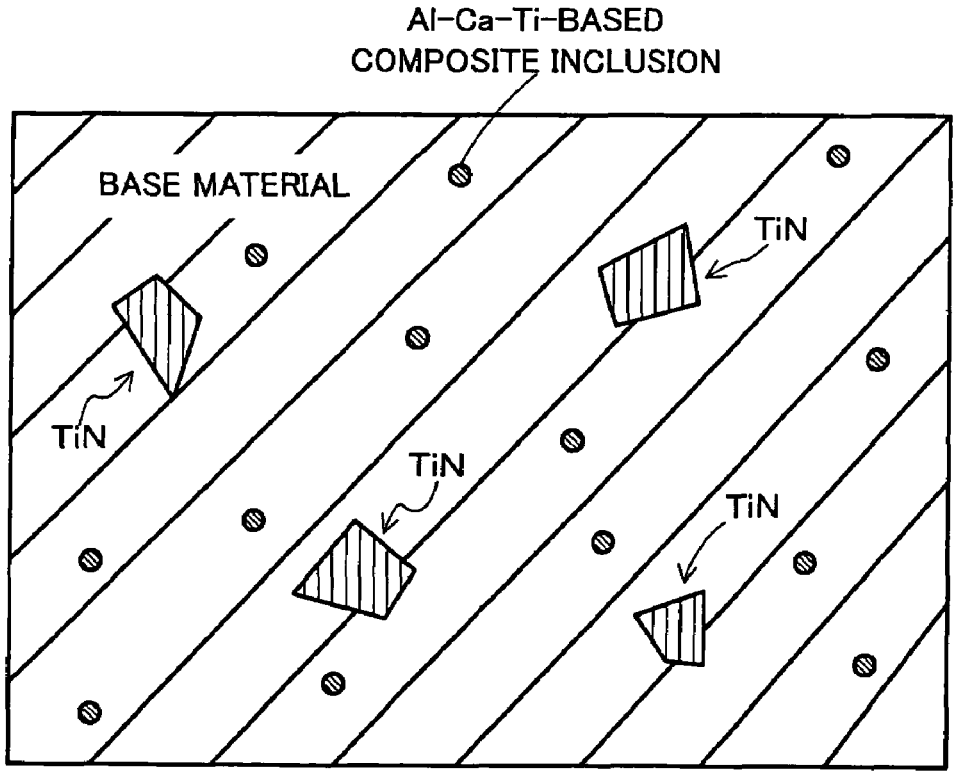
FIG. 3B is a schematic view showing the shapes of inclusions in a steel product for a line pipe according to an embodiment of the invention.

The inventors have found, in one method of manufacturing a steel product for a line pipe according to the embodiment, that producing Al—Ca—Ti-based composite inclusions in the steel allows TiNs in the steel to have a reduced size. According to a conventional manufacturing method, a plurality of TiNs are produced in steel as shown in FIG. 3A. Meanwhile, as shown in FIG. 3B, according to the manufacturing method by the inventors, fine Al—Ca—Ti-based composite inclusions and TiNs having smaller sizes than the conventional case are produced. Now, a method of manufacturing a steel product for use as a line pipe according to the embodiment will be described.

Figure 4:
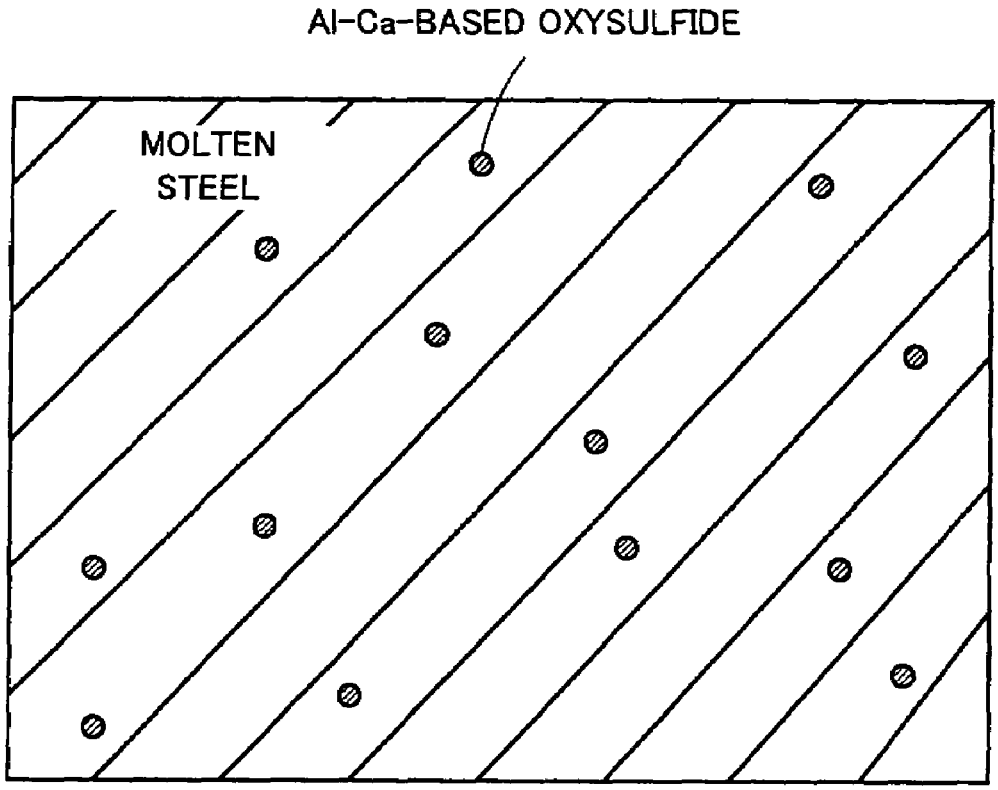
FIG. 4 is a schematic view showing the shapes of inclusions in molten steel in melting process for a steel product for a line pipe according to an embodiment of the invention.

In the method of manufacturing a steel product for use as a line pipe according to the embodiment, as shown in FIG. 4, a lot of fine Al—Ca-based oxysulfides are produced during melting. The Al—Ca-based oxysulfides have extremely low solubility in molten steel and are finely dispersed in the molten steel.

Figure 5:
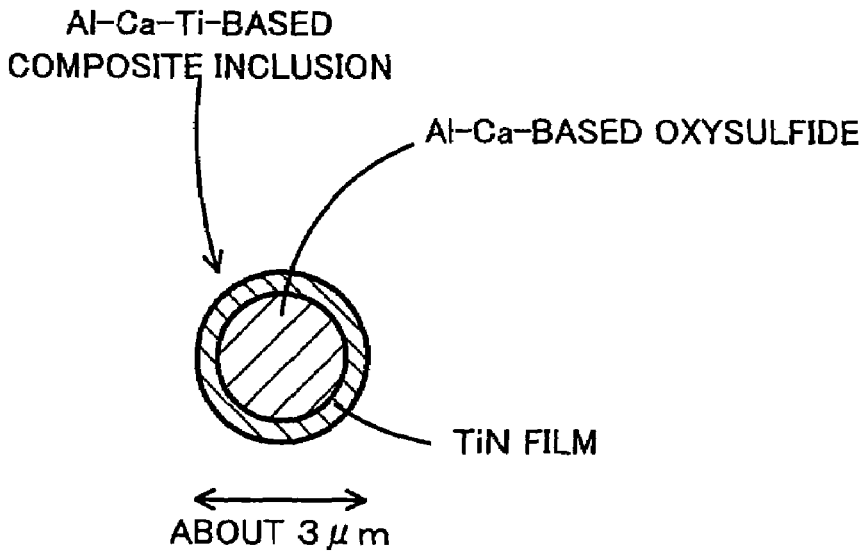
FIG. 5 is a schematic view showing the shape of an Al—Ca—Ti-based composite inclusion in FIG. 3B.

Then, the molten steel is cooled. At the time, as shown in FIG. 3B, Al—Ca—Ti-based composite inclusions and TiNs are produced. As shown in FIG. 5, the Al—Ca—Ti-based composite inclusions consist of the Al—Ca-based oxysulfide produced during melting and a TiN covering the surface (hereinafter simply as "TiN film"). More specifically, the TiN film is produced on the surface of the Al—Ca-based oxysulfide during cooling the molten steel, and therefore the Al—Ca-based oxysulfide turns into the Al—Ca—Ti-based composite inclusion. The Al—Ca—Ti-based composite inclusion has a substantially spherical shape whose major axis is about 3 μm.

In this way, according to the embodiment, a part of TiN as in the conventional case in FIG. 3A covers the Al—Ca-based oxysulfide as the TiN film and is included in the Al—Ca—Ti-based composite inclusions. Therefore, the size of TiN that precipitate in the steel is smaller than the conventional case as shown in FIG. 3B.

As described above, in order to reduce the size of TiN by forming the Al—Ca—Ti-based oxysulfides, the following manufacturing conditions (A) to (C) should be satisfied.

(A) When the concentration of Ca in the Al—Ca-based oxysulfide is about the same as the concentration of Al, Al—Ca—Ti-based composite inclusions are more likely to form. Therefore, 0.1 kg/ton to 0.3 kg/ton Ca by purity content is preferably added during melting in order to substantially equalize the concentration of Ca with the concentration of Al in the Al—Ca-based oxysulfides. Note that pure Ca may be added or a Ca alloy such as CaSi may be added. The adding speed, the ladle form and the like are not specified.

(B) In order to average the compositions of the plurality of Al—Ca-based oxysulfides produced during melting, the slag compositions are preferably controlled during melting. More specifically, the weight ratio of $CaO/Al_2O_3$ in the slag is preferably from 1.2 to 1.5.

(C) The cooling rate at the time of casting is preferably low, and the cooling rate during the period between 1500° C. to 1000° C. is preferably not more than 500° C./min. This is for securing enough time for Ti to diffuse around the Al—Ca-based oxysulfides and TiN films to form.

Semifinished products after casting are processed into line pipes by a process (such as rolling) the same as the conventional processing step. More specifically, steel plates obtained by hot-rolling the semifinished products such as slabs are welded and formed into line pipes (welded pipes). Alternatively, billets obtained by blooming an ingot or billets obtained by continues casting are used as a material and produced into seamless line pipes using a cross-roll piercer or the like.

Note that if all the above manufacturing conditions (A) to (C) are not satisfied, another condition to control may be added so that the size of TiN in the steel is not more than 30 μm.

Such an additional condition may be for example the process of reducing the amount of Ti or N to be added, or the process of removing large TiNs. In the process of removing large TiNs, the steel melting temperature is raised using a tundish heater for example to remove the large TiNs from molten steel by flotation.

EXAMPLE 1

Line pipes (welded pipes) of inventive steels and comparative steels having TiN sizes as given in Table 2 were examined for the crack area ratio CAR and the yield stress YS.

TABLE 2

| | compositions (with the balance of Fe and impurities, in mass %) | | | | | | | | | | | | |
|---|---|---|---|---|---|---|---|---|---|---|---|---|---|
| | C | Si | Mn | P | S | Al | Ca | Ti | N | O | Cr | Mo | Nb |
| inventive steels | | | | | | | | | | | | | |
| 1 | 0.05 | 0.18 | 1.23 | 0.007 | 0.0031 | 0.022 | 0.002 | 0.015 | 0.0041 | 0.0040 | | | |
| 2 | 0.04 | 0.20 | 1.12 | 0.008 | 0.0029 | 0.051 | 0.007 | 0.014 | 0.0043 | 0.0043 | | | |
| 3 | 0.06 | 0.22 | 1.67 | 0.006 | 0.0034 | 0.026 | 0.005 | 0.015 | 0.0044 | 0.0041 | | | |
| 4 | 0.08 | 0.19 | 1.78 | 0.005 | 0.0021 | 0.031 | 0.004 | 0.013 | 0.0034 | 0.0033 | | | |
| 5 | 0.05 | 0.17 | 1.41 | 0.007 | 0.0021 | 0.015 | 0.004 | 0.016 | 0.0033 | 0.0034 | 0.53 | | |
| 6 | 0.04 | 0.25 | 1.45 | 0.002 | 0.0028 | 0.021 | 0.005 | 0.017 | 0.0028 | 0.0046 | | 0.31 | |
| 7 | 0.05 | 0.15 | 1.28 | 0.005 | 0.0011 | 0.014 | 0.005 | 0.013 | 0.0045 | 0.0031 | | | 0.023 |
| 8 | 0.04 | 0.24 | 1.33 | 0.007 | 0.0009 | 0.022 | 0.004 | 0.015 | 0.0049 | 0.0038 | | | |
| 9 | 0.06 | 0.27 | 1.16 | 0.008 | 0.0024 | 0.022 | 0.005 | 0.015 | 0.0035 | 0.0035 | | | |
| 10 | 0.04 | 0.16 | 1.39 | 0.006 | 0.0031 | 0.023 | 0.005 | 0.015 | 0.0039 | 0.0043 | 0.61 | 0.28 | |
| 11 | 0.05 | 0.23 | 1.34 | 0.005 | 0.0038 | 0.024 | 0.003 | 0.017 | 0.0042 | 0.0041 | | | |
| 12 | 0.04 | 0.22 | 1.35 | 0.004 | 0.0022 | 0.025 | 0.004 | 0.015 | 0.0041 | 0.0046 | | | |
| 13 | 0.06 | 0.18 | 1.28 | 0.006 | 0.0026 | 0.019 | 0.005 | 0.013 | 0.0035 | 0.0048 | | | |
| 14 | 0.06 | 0.19 | 1.44 | 0.008 | 0.0024 | 0.018 | 0.006 | 0.014 | 0.0036 | 0.0031 | 0.51 | 0.33 | |
| comparative steels | | | | | | | | | | | | | |
| A | 0.04 | 0.18 | 1.03 | 0.005 | 0.0018 | 0.004 | 0.005 | 0.013 | 0.0039 | 0.0034 | | | |
| B | 0.06 | 0.23 | 1.24 | 0.007 | 0.0330 | 0.013 | 0.013 | 0.015 | 0.0036 | 0.0041 | | | |
| C | 0.03 | 0.25 | 1.34 | 0.007 | 0.0041 | 0.009 | 0.019 | 0.015 | 0.0041 | 0.0038 | | | |
| D | 0.05 | 0.20 | 1.32 | 0.005 | 0.0034 | 0.034 | 0.004 | 0.014 | 0.0034 | 0.0035 | | | |
| E | 0.05 | 0.22 | 1.28 | 0.006 | 0.0008 | 0.034 | 0.005 | 0.014 | 0.0031 | 0.0036 | | | |
| F | 0.05 | 0.24 | 1.24 | 0.007 | 0.0007 | 0.041 | 0.004 | 0.016 | 0.0038 | 0.0041 | | | |

TABLE 2-continued

| | compositions (with the balance of Fe and impurities, in mass %) | | | | manufacturing conditions | | | | | |
|---|---|---|---|---|---|---|---|---|---|---|
| | V | B | Cu | Ni | Ca addition (kg/ton) | slag composition ($CaO/Al_2O_3$) | cooling rate (° C./min) | TiN (μm) | YS (MPa) | CAR (%) |
| inventive steels | | | | | | | | | | |
| 1 | | | | | 0.11 | 1.2 | 450 | 25 | 453 | 2.0 |
| 2 | | | | | 0.21 | 1.4 | 250 | 11 | 468 | 0.6 |
| 3 | | | | | 0.22 | 1.3 | 250 | 12 | 470 | 0.6 |
| 4 | | | | | 0.20 | 1.4 | 250 | 11 | 460 | 0.5 |
| 5 | | | | | 0.13 | 1.3 | 50 | 10 | 556 | 0.5 |
| 6 | | | | | 0.15 | 1.3 | 50 | 15 | 544 | 0.0 |
| 7 | | | | | 0.16 | 1.3 | 150 | 15 | 523 | 0.8 |
| 8 | 0.041 | | | | 0.13 | 1.3 | 50 | 12 | 560 | 0.0 |
| 9 | | 0.0003 | | | 0.14 | 1.3 | 450 | 18 | 559 | 0.5 |
| 10 | | 0.0002 | | | 0.15 | 1.4 | 50 | 15 | 601 | 0.0 |
| 11 | | | | 0.19 | 0.13 | 1.3 | 100 | 12 | 454 | 0.6 |
| 12 | | | 0.3 | | 0.14 | 1.3 | 100 | 18 | 447 | 0.7 |
| 13 | | | 0.33 | 0.21 | 0.15 | 1.3 | 200 | 15 | 456 | 0.3 |
| 14 | | | 0.31 | 0.21 | 0.17 | 1.4 | 150 | 17 | 560 | 0.9 |
| comparative steels | | | | | | | | | | |
| A | | | | | 0.14 | 1.3 | 1000* | 48 | 469 | 15.3 |
| B | | | | | 0.28 | 1.6* | 250 | 36 | 456 | 7.5 |
| C | | | | | 0.45* | 1.7* | 250 | 42 | 475 | 11.0 |
| D | | | | | 0.09* | 1.3 | 150 | 37 | 455 | 4.8 |
| E | | | | | 0.13 | 1.3 | 700* | 32 | 463 | 3.4 |
| F | | | | | 0.12 | 1.1* | 150 | 44 | 449 | 10.5 |

*outside the range of preferred manufacturing conditions

The inventive steels 1 to 14 were produced as follows. Molten steel in the manufacturing conditions in Table 2 (Ca addition amounts, slag compositions, and cooling rates) was continuously cast to produce slabs. The slabs were heated to 1050° C. to 1200° C. and then each formed into a steel plate as thick as 15 mm to 20 mm by hot-rolling. After quenching-tempering, the steel plates were formed into line pipes by welding. In the process of quenching-tempering, the steel plates were heated to 850° C. to 950° C. followed by water-cooling, again heated to 500° C. to 700° C. followed by air cooling.

Test specimens having a thickness of 10 mm, a width of 20 mm and a length of 100 mm were produced from the inventive steels and measured for the size of TiN. More specifically, the test specimens mounted in resin blocks had their surfaces subjected to polishing and observed each for five regions of 1 $mm^2$ using an SEM (scanning electron microscope) of 100 times power. The largest ten TiNs in each of the regions were selected and measured for the major axis. Then, the average of the measured major axes was the size of the TiN.

The size of TiN in the inventive steels 1 to 14 was a value smaller than 30 μm defined according to the invention.

Comparative steels A to F have the same chemical composition as the inventive steels. However, they do not satisfy all the manufacturing conditions (A) to (C), and therefore the size of the TiN was larger than 30 μm defined according to the invention. More specifically, the comparative steels A and E have a cooling rate higher than 500° C./min and the $CaO/Al_2O_3$ weight ratio (slag composition) of the comparative steels B and F was out of the range of 1.2 to 1.5. The Ca addition amount in the comparative steel D is less than 0.1 kg/ton. The comparative steel C did not satisfy the conditions for the slag composition and the Ca addition amount. The other manufacturing process is the same as that of the steels 1 to 14. Note that the method of measuring the size of TiN was the same as that of the inventive steels.

Evaluation Tests for HIC Resistance and Strength

Test specimens (having a thickness of 10 mm, a width of 20 mm, and a length of 100 mm) taken from the inventive steels and the comparative steels were subjected to an HIC test. In the HIC test, the test specimens were immersed for 96 hours in a hydrogen sulfide-saturated, aqueous solution of 0.5% acetic acid and 5% sodium chloride at 1 atm and 25° C. The area of HIC generated in the test specimens after the test was measured by ultrasonic testing and the crack area ratio CAR was obtained from Expression (1). Note that the area of the test specimens in Expression (1) was 20 mm×100 mm.

The yield stresses YS of the inventive steels and the comparative steels were obtained. More specifically, two tensile test specimens having a gauge diameter of 6 mm and a gauge length of 40 mm were taken from the center portion of the wall thickness of the line pipes longitudinally and subjected to tensile tests at room temperatures. The yield stress YS of each of the steels was obtained as the average of the yield stresses YS of the two tensile test specimens.

Test Result

In the inventive steels 1 to 14, the crack area ratio CAR was lower than 3%. Therefore, the crack area ratio was reduced to less than 3% when the size of TiN was not more than 30 μm.

Meanwhile, in the comparative steels A to F, the crack area ratio CAR was more than 3%. This is because all the conditions (A) to (C) during melting steel were not satisfied, and therefore the size of TiN was more than 30 μm, which increased the crack area ratio.

The yield stresses YS of the inventive steels 1 to 4 were in the range from 453 MPa to 470 MPa, while the yield stresses YS of the inventive steels 5 to 10 containing Cr, Mo, Nb, V, and B were in the range from 523 MPa to 601 MPa, and the strength of the steels were increased.

The crack area ratios CAR of the inventive steels 5 to 10 were less than 1%. More specifically, by adding these elements, the strength of the steel product increased and yet the effect of reducing HIC was not impaired.

In addition, in the inventive steels 11 to 13 containing Cu and Ni, the crack area ratio CAR was less than 1%.

The inventive steel 14 contains Cr and Mo as well as Cu and Ni. By adding these elements, the strength of the steel product increased to 560 MPa, and the crack area ratio was reduced to less than 1%.

EXAMPLE 2

Seamless line pipes produced using the inventive steels and the comparative steels having compositions and TiN sizes as given in Table 3 were produced and examined for the crack area ratio CAR and the yield stress YS similarly to Example 1.

TABLE 3

| | compositions (with the balance of Fe and impurities, in mass %) | | | | | | | | | | | | |
|---|---|---|---|---|---|---|---|---|---|---|---|---|---|
| | C | Si | Mn | P | S | Al | Ca | Ti | N | O | Cr | Mo | Nb |
| inventive steels | | | | | | | | | | | | | |
| 15 | 0.05 | 0.17 | 1.01 | 0.008 | 0.0034 | 0.091 | 0.005 | 0.014 | 0.0061 | 0.0034 | | | |
| 16 | 0.07 | 0.14 | 0.99 | 0.007 | 0.0031 | 0.075 | 0.005 | 0.015 | 0.0062 | 0.0041 | | | |
| 17 | 0.08 | 0.22 | 0.98 | 0.009 | 0.0029 | 0.061 | 0.003 | 0.016 | 0.0059 | 0.0045 | | | |
| 18 | 0.09 | 0.17 | 1.12 | 0.007 | 0.0031 | 0.042 | 0.005 | 0.015 | 0.0040 | 0.0038 | | | |
| 19 | 0.07 | 0.16 | 1.43 | 0.007 | 0.0021 | 0.031 | 0.003 | 0.017 | 0.0059 | 0.0049 | | | |
| 20 | 0.08 | 0.21 | 1.69 | 0.006 | 0.0035 | 0.026 | 0.004 | 0.014 | 0.0043 | 0.0034 | | | |
| 21 | 0.07 | 0.22 | 1.79 | 0.005 | 0.0034 | 0.033 | 0.005 | 0.013 | 0.0051 | 0.0035 | | | |
| 22 | 0.05 | 0.15 | 1.41 | 0.009 | 0.0019 | 0.026 | 0.002 | 0.020 | 0.0041 | 0.0043 | 0.41 | | |
| 23 | 0.06 | 0.18 | 1.44 | 0.007 | 0.0024 | 0.024 | 0.002 | 0.016 | 0.0038 | 0.0038 | | 0.28 | |
| 24 | 0.04 | 0.19 | 1.31 | 0.011 | 0.0023 | 0.023 | 0.003 | 0.011 | 0.0043 | 0.0041 | | | 0.025 |
| 25 | 0.07 | 0.16 | 1.32 | 0.007 | 0.0011 | 0.022 | 0.002 | 0.014 | 0.0044 | 0.0038 | | | |
| 26 | 0.04 | 0.18 | 1.30 | 0.012 | 0.0022 | 0.034 | 0.003 | 0.015 | 0.0046 | 0.0045 | | | |
| 27 | 0.09 | 0.11 | 1.29 | 0.006 | 0.0023 | 0.026 | 0.002 | 0.013 | 0.0039 | 0.0044 | 0.48 | 0.31 | 0.021 |
| 28 | 0.05 | 0.20 | 1.33 | 0.008 | 0.0015 | 0.039 | 0.002 | 0.015 | 0.0064 | 0.0046 | | | |
| 29 | 0.08 | 0.19 | 1.42 | 0.005 | 0.0024 | 0.025 | 0.003 | 0.016 | 0.0051 | 0.0039 | | | |
| 30 | 0.07 | 0.18 | 1.34 | 0.007 | 0.0029 | 0.024 | 0.003 | 0.017 | 0.0062 | 0.0034 | | | |
| 31 | 0.04 | 0.23 | 1.35 | 0.009 | 0.0018 | 0.023 | 0.003 | 0.018 | 0.0062 | 0.0036 | 0.51 | 0.34 | 0.021 |
| comparative steels | | | | | | | | | | | | | |
| G | 0.08 | 0.16 | 0.97 | 0.011 | 0.0029 | 0.055 | 0.011 | 0.015 | 0.0041 | 0.0042 | | | |
| H | 0.09 | 0.22 | 0.97 | 0.008 | 0.0036 | 0.044 | 0.012 | 0.014 | 0.0051 | 0.0043 | | | |
| I | 0.08 | 0.17 | 0.99 | 0.007 | 0.0011 | 0.061 | 0.002 | 0.013 | 0.0055 | 0.0041 | | | |
| J | 0.07 | 0.23 | 1.02 | 0.008 | 0.0014 | 0.043 | 0.002 | 0.015 | 0.0046 | 0.0039 | | | |

| | compositions (with the balance of Fe and impurities, in mass %) | | | | manufacturing conditions | | | | | |
|---|---|---|---|---|---|---|---|---|---|---|
| | V | B | Cu | Ni | Ca addition (kg/ton) | slag composition ($CaO/Al_2O_3$) | cooling rate (° C./min) | TiN (μm) | YS (MPa) | CAR (%) |
| inventive steels | | | | | | | | | | |
| 15 | | | | | 0.15 | 1.4 | 450 | 27 | 456 | 2.5 |
| 16 | | | | | 0.20 | 1.5 | 150 | 18 | 450 | 0.2 |
| 17 | | | | | 0.13 | 1.2 | 100 | 12 | 457 | 0.6 |
| 18 | | | | | 0.14 | 1.5 | 250 | 10 | 457 | 0.0 |
| 19 | | | | | 0.11 | 1.2 | 250 | 15 | 456 | 0.0 |
| 20 | | | | | 0.13 | 1.3 | 250 | 11 | 461 | 0.2 |
| 21 | | | | | 0.11 | 1.4 | 250 | 12 | 468 | 0.3 |
| 22 | | | | | 0.12 | 1.2 | 100 | 12 | 543 | 0.0 |
| 23 | | | | | 0.11 | 1.2 | 220 | 13 | 546 | 0.0 |
| 24 | | | | | 0.12 | 1.2 | 220 | 17 | 522 | 0.3 |
| 25 | 0.06 | | | | 0.13 | 1.2 | 240 | 15 | 556 | 0.3 |
| 26 | | 0.0003 | | | 0.16 | 1.3 | 340 | 19 | 565 | 0.5 |
| 27 | 0.038 | 0.0002 | | | 0.14 | 1.2 | 120 | 16 | 580 | 0.4 |
| 28 | | | 0.31 | | 0.13 | 1.2 | 120 | 12 | 455 | 0.2 |
| 29 | | | | 0.21 | 0.15 | 1.3 | 340 | 18 | 449 | 0.6 |
| 30 | | | 0.28 | 0.22 | 0.14 | 1.2 | 150 | 14 | 455 | 0.4 |
| 31 | 0.041 | | 0.31 | 0.21 | 0.15 | 1.3 | 200 | 13 | 586 | 0.3 |

TABLE 3-continued

| comparative steels | | | | | | |
|---|---|---|---|---|---|---|
| G | 0.27 | 1.6* | 250 | 38 | 450 | 4.8 |
| H | 0.45* | 1.4 | 200 | 45 | 456 | 8.0 |
| I | 0.12 | 1.0* | 250 | 43 | 455 | 5.1 |
| J | 0.05* | 1.3 | 150 | 38 | 456 | 3.5 |

*outside the range of preferred manufacturing conditions

The inventive steels 15 to 31 were produced as follows. To begin with, billets were produced by continues casting from molten steel melted in the conditions in Table 3. The billets were then heated to 1200° C. to 1250° C. followed by piercing by a cross-roll piercer, rolling and then produced into seamless line pipes. The line pipes were then heated to 850° C. to 950° C. followed by cooling with water, then heated to 500° C. to 700° C. followed by air cooling.

The method of measuring the size of TiN in the steel products and the method of evaluating the HIC resistance and strength are the same as those according to Example 1.

Note that the sizes of TiN in the inventive steels 15 to 31 were smaller than 30 μm defined according to the invention.

The comparative steels G to J have the same chemical composition as that of the inventive steels but do not satisfy all the conditions (A) to (C), and therefore the sizes of the TiN were greater than 30 μm defined according to the invention. More specifically, the $CaO/Al_2O_3$ weight ratios (slag composition) of comparative steels G and I were out of the range of 1.2 to 1.5. The Ca addition amounts of the comparative steels H and J were out of the range of 0.1 kg/ton to 0.3 kg/ton. The other manufacturing process was the same as that of the inventive steels 15 to 31.

Test Results

In the inventive steels 15 to 31, the crack area ratio CAR was lower than 3%. Therefore, similarly to Example 1, the size of TiN was not more than 30 μm, so that the crack area ratio was reduced to less than 3%.

Meanwhile, in the comparative steels G to J, the sizes of TiN were more than 30 μm because all the conditions (A) to (C) during melting were not satisfied, and therefore, the crack area ratio CAR was more than 3%.

The yield stresses YS of the inventive steels 22 to 27 containing Cr, Mo, Nb, V, and B were in the range from 522 MPa to 580 MPa, and the strength of the steel products were higher than the inventive steels 15 to 21 without the addition of these elements. Furthermore, the inventive steels 28 to 30 containing Cu and Ni, the elements restraining hydrogen from penetrating in, had a crack area ratio CAR that was less than 1%. The inventive steel 31 had its yield stress YS increased to 586 MPa by the addition of Cr, Mo, Nb, and V. In addition, the crack area ratio CAR was reduced.

Although the present invention has been described and illustrated in detail, it is understood that the same is by way of illustration and example only and is not to be taken by way of limitation. The invention may be embodied in various modified forms without departing from the spirit and scope of the invention.

INDUSTRIAL APPLICABILITY

The steel product for use as a line pipe according to the invention is applicable to a line pipe for use in transporting crude oil or natural gas.

The invention claimed is:

1. A steel product with high HIC resistance for use as a line pipe, comprising in mass %:

C: 0.03% to 0.15%, Si: 0.05% to 1.0%, Mn: 0.5% to 1.8%, P: 0.015% or less, S: 0.004% or less, O (oxygen) : 0.01% or less, N: 0.007% or less, sol. Al: 0.01% to 0.1%, Ti: 0.024% or less, and Ca: 0.0003% to 0.02%, the balance consisting of Fe and impurities, wherein five regions of 1 $mm^2$ on a section of said steel product are observed, ten largest exposed TiN inclusions are selected for each of the observed regions, major axes of the selected TiN inclusions are measured, and a size of the TIN inclusion defined as the average of the measured major axes is from 10 μm to 30 μm.

2. The steel product according to claim 1, further comprising at least one of Cu: 0.1% to 0.4%, and Ni: 0.1% to 0.3%.

3. The steel product according to claim 1, further comprising:

at least one of Cr: 0.01% to 1.0%, Mo: 0.01% to 1.0%, V: 0.01% to 0.3%, B: 0.0001% to 0.001%, and Nb: 0.003% to 0.1%.

4. The steel product according to claim 2, further comprising:

at least one of Cr: 0.01% to 1.0%, Mo: 0.01% to 1.0%, V: 0.01% to 0.3%, B: 0.0001% to 0.001%, and Nb: 0.003% to 0.1%.

5. A line pipe with high HIC resistance comprising in mass %: C: 0.03% to 0.15%, Si: 0.05% to 1.0%, Mn: 0.5% to 1.8%, P: 0.015% or less, S: 0.004% or less, O (oxygen): 0.01% or less, N: 0.007% or less, sol. Al: 0.01% to 0.1%, Ti: 0.024% or less, and Ca: 0.0003% to 0.02%, the balance consisting of Fe and impurities, wherein five regions of 1 $mm^2$ on a section of said steel product are observed, ten largest exposed TiN inclusions are selected for each of the observed regions, major axes of the selected TIN inclusions are measured, and a size of the TIN inclusion defined as the average of the measured major axes is from 10 μm to 30 μm.

6. The line pipe according to claim 5, further comprising at least one of Cu: 0.1% to 0.4%, and Ni: 0.1% to 0.3%.

7. The line pipe according to claim 6, further comprising:

at least one of Cr 0.01% to 1.0%, Mo: 0.01% to 1.0%, V: 0.01% to 0.3%, B: 0.0001% to 0.001%, and Nb: 0.003% to 0.1%.

8. The line pipe according to claim 5, further comprising:

at least one of Cr 0.01% to 1.0%, Mo: 0.01% to 1.0%, V: 0.01% to 0.3%, B: 0.0001% to 0.001%, and Nb: 0.003% to 0.1%.

* * * * *